US006470608B1

(12) United States Patent
Edwards

(10) Patent No.: US 6,470,608 B1
(45) Date of Patent: Oct. 29, 2002

(54) NETWORKING CARD

(76) Inventor: Brian J. P. H. Edwards, 132 Greenhill, Hampstead, London NW3 5TY (GB)

( * ) Notice: Subject to any disclaimer, the term of this patent is extended or adjusted under 35 U.S.C. 154(b) by 0 days.

(21) Appl. No.: 09/437,821

(22) Filed: Nov. 10, 1999

(51) Int. Cl.[7] ..... G09F 1/00; B42D 15/00

(52) U.S. Cl. ..... 40/124; 40/124.01; 40/124.11; 283/3.1; 283/15.1; 283/63.1

(58) Field of Search ..... 40/124, 124.01, 40/124.11; 283/281, 3.1, 15.1, 63.1; 229/92.8

(56) References Cited

U.S. PATENT DOCUMENTS 2,417,982 A * 3/1947 Histed ..... 281/15.1
3,894,755 A 7/1975 Cieslak et al. ..... 283/1
4,589,590 A * 5/1986 McGuire et al. ..... 281/15.1
4,613,157 A 9/1986 Drabish ..... 283/1 R

FOREIGN PATENT DOCUMENTS

WO 9934985 7/1999 ..... B42D/15/02

* cited by examiner

*Primary Examiner*—Anthony Knight
*Assistant Examiner*—Enoch E Peavey
(74) *Attorney, Agent, or Firm*—Conley, Rose & Tayon, P.C.

(57) ABSTRACT

A networking card has a plurality of pages for bearing at least one of a greeting or other message, a drawing and an object added to the networking card by successive recipients of the networking card. The networking card can be purchased by an initial sender. That person can add a message to a first page of the card and then send it to a first recipient. The first recipient in turn can add his or her own message to the networking card, for example on a second page of the networking card, and then send the card on to a second recipient. The process can be repeated until for example all of the pages have been used.

8 Claims, 3 Drawing Sheets

NETWORKING CARD

The present invention relates to a networking card and to a method of sending a networking card.

BACKGROUND OF THE INVENTION

All greetings cards and postcards known to the applicant are merely intended to be sent or given by a single sender or giver to a single recipient, where the sender or giver and the recipient are each always a different person or group or corporation of persons. As such, the sender or giver of known greetings cards and postcards always knows or knows of the recipient to whom he or she is sending or giving the card, and the recipient may not necessarily be in a different location from the sender or giver. By definition, the message in, or the content of, a greetings card or postcard received by a recipient is always fully predetermined by a single sender before the card is sent or given.

It is desirable to provide a card in which the message can be supplemented or modified. It is also desirable to provide a card that can be sent and received by a plurality of individuals in series, for the purpose of establishing a network between those individuals.

SUMMARY OF THE INVENTION

An objective of the present invention is to provide a networking card which can be circulated by repeated physical postings amongst a dispersed network or group of people, each of whom can add to or alter the contents of the card, prior to the card being finally received by an ultimate recipient. Another objective is to provide a networking card which can be sent by an initial sender to himself or herself indirectly via an intermediate network or group of dispersed people, who do not necessarily all know or know of each other.

According to a first aspect of the present invention, there is provided a networking card, the networking card comprising a plurality of pages for bearing at least one of a greeting or other message, a drawing and an object added to the networking card by successive recipients of the networking card.

The networking card can be purchased by an initial sender. That person can add a message to a first page of the card and then send the card to a first recipient. The first recipient in turn can add his or her own message to the card, for example on a second page of the card, and then send the card on to a second recipient. The process can be repeated until for example all of the pages have been used. In this way, a card is provided which facilitates "networking" of people, i.e. it allows for the exchange of ideas, information, contacts or experiences amongst a dispersed group or network of people, for a variety of social and professional purposes. For example, the card can be used to develop joint ideas or projects, to make new friends or professional contacts, to sell or search for items amongst friends, and friends of friends, write collaborative stories, or play new games. The card can be used as part of a fund-raising exercise, for example for charity.

The card may have a page or other region on the card for bearing the name and address of the intended ultimate recipient of the card. The initial sender can insert the name and address of the intended ultimate recipient of the card on the page or region provided. The ultimate recipient may be the initial sender or some other person.

It will be understood that when a card is "sent" from one person to another, the card will typically be sent by means of a postal service (whether a state-run postal service or a private postal or courier or other physical delivery service).

Objects, such as photographs, small gifts or the like, may be added to the card by senders.

The card can be used for various purposes, as discussed in more detail below. Briefly, the card can be used as part of a game, in telling a story, as part of a fund-raising exercise for example for charity, or to provide a commemorative gift or memento. Competitions could be held to find the longest card, the card that has been through the most countries, etc. Such competitions could simply be for fun, or may be sponsored with prizes being given, or for fund-raising for example for charity.

The card can be used in a "self-returning" manner for example where the card is sent on from one person to another until eventually it is sent on from the last recipient to the initial sender. In this usage, consecutive recipients/senders (though possibly with the exception of the last recipient and the initial sender) will normally always know each other and all recipients/senders will therefore be friends of friends of each other without all of them necessarily knowing each other. In this usage also, the card can be initiated by a sender for or on behalf of someone else to whom the completed card can eventually be sent by the last recipient. In this usage, the ultimate recipient may appropriately be a mutual friend of the initial sender and the first recipient.

By way of another example, the card can be used in a "non-returning" manner where the card is always initiated for someone else and circulated amongst a network or group of people all of whom already know or are connected with each other. This second usage may be particularly desirable where the card is used to provide a single memento of some special occasion by a group of people who are all in geographically separated locations. For example, an important anniversary or other event in a family may be commemorated by sending the card successively from one family member to another, with each family member adding a personal message relating to the anniversary or other event, with the card finally arriving in the post as a joint commemorative gift to the ultimate recipient(s).

The card may have pockets or adhesive pads or some other means allowing photographs, small gifts, etc to be inserted into the card by individual recipients.

The card may have a portion for bearing name and address details of an initial sender of the card. As mentioned above, the initial sender may be the ultimate recipient.

The card may comprise a connector for connecting the card to another networking card or to an extension card. This allows the card to be extended by adding further cards if necessary or desired to provide an extended card having further pages. The further cards may be substantially identical to the first card. The connector may be provided on a rear cover of the card. The connector may be provided on a front cover of the card. A connector may be provided on both a front cover and a rear cover of the card. This allows the networking card to be extended, in principle as many times as desired, by adding further cards to provide a composite extendible networking card having further pages.

The connector may comprise an adhesive. The connector may comprise a detachable protective cover. The detachable protective cover can be removed to allow the networking card to be securely connected to another networking card. Alternatively, the detachable protective cover can be removed and reversed to disable the connector. The initial sender can disable the connector before sending the networking card to a first recipient, in which case the networking card may be sent to the ultimate recipient as soon as all of the pages have been used. As mentioned above, the initial sender may be the ultimate recipient. If the connector has not been disabled, a second networking card can be purchased and connected to the first networking card by an intermediate recipient/sender or by the final recipient of the first networking card, and the process can continue with the extended composite networking card. The composite networking card can be extended again in the same manner.

The initial sender and intermediate recipients/senders of the single or composite networking card may each also insert their own name and address details on the card. In this case they may receive the circulating card back again with a message from a subsequent recipient/sender whom they may or may not know. They may then themselves re-use the card to reply to the known or unknown sender, or re-send the card to another known or unknown intermediate recipient/sender on the network, or send the card to a new known recipient who is not on the network. Therefore, a postal networking card may not always circulate in simple circles. Alternatively or additionally, recipients/senders may add their telephone or fax numbers or e-mail addresses, in which case they may also receive or initiate separate parallel communication with other recipients/senders on the evolving network. It is not necessary for the initial sender or intermediate recipients/senders to provide any personal details on the networking card in order to create a new network of people or to participate in a postal networking card.

The single or composite networking card can be used to exchange ideas, information, contacts or experiences amongst a dispersed group or network of people, for a variety of social and professional purposes. For example, the card can be used to develop joint ideas or projects, to make new friends or professional contacts, to sell or search for items amongst friends, and friends of friends, write collaborative stories, or play new games. The card can also be used from time to time to build into singular national or international events, to mark major occasions or promote current issues, raising awareness and also funds. Such events may attract media coverage and generate competitions to find for example the longest or most amusing or most multinational card. Such events may be initiated for charity fundraising purposes, for example for disaster relief. In such usage, it may be necessary or desirable that networking cards are extended several times and special extension cards may be provided to facilitate the process.

The networking card may comprise one or more tokens for affixing to a page or other portion of the card. The page or other portion may be detachable. Where a connector with a detachable protective cover is provided, a token or tokens can be affixed to the detachable protective cover of the connector, which in this usage will not normally be disabled. A token or tokens can also be affixed to a detachable page or portion or corresponding detachable protective cover of another networking card, by recipients/senders of a networking card who themselves purchase new networking cards to start up new networks. The tokens provided with a networking card might be non-matching. After a sufficient number of tokens have been affixed to a networking card, the detachable page or portion or protective cover containing the tokens can be detached and redeemed at a retailer in exchange for a special (non-purchasable) extension card, which can then be affixed by means of the exposed adhesive connector on the completed card.

The special (non-purchasable) extension card allows the first networking card to be extended without a new card having to be purchased by an individual recipient/sender of the networking card merely for the purpose of extending the networking card. A special (non-purchasable) extension card can be obtained and added to the networking card by any intermediate recipient/sender as soon as the required number of appropriate tokens have been affixed to a networking card.

The special (non-purchasable) extension card may be substantially identical to the networking card described previously, comprising a connector on the rear cover of the extension card for connecting the extended composite networking card to another networking card or to another special (non-purchasable) extension card. As the composite networking card circulates, it can re-acquire further redeemable tokens if subsequent recipients/senders purchase and start up their own networking cards on receipt of the extended composite networking card. This allows the networking card to be extended, in principle as many times as desired, without any individual recipient/sender having to purchase a new card merely for the purpose of extending the networking card.

However, special (non-purchasable) extension cards may be noticeably different from purchasable networking cards. For example they may have a blank front cover, which may also be made of thinner material, and the whole special extension card may be made in a distinctively different colour. These visible differences are intended to deter recipients/senders of a networking card from using freely obtained extension cards to start up new networking cards of their own, instead of attaching the special extension card to the networking card from which the redeemable tokens have been obtained. Given the socially interactive nature of networking cards, it is expected that recipients/senders will be unlikely to start up their own networking cards at the expense of someone else's networking card in which they feature. This is particularly so where special (non-purchasable) extension cards are employed for large-scale charity fundraising events.

Networking cards can in any event be extended repeatedly without the use of tokens or special (non-purchasable) extension cards, as described previously.

According to another aspect of the present invention, there is provided in combination, a networking card as described above, an extension card, and a connector for connecting the extension card to the networking card thereby to provide an extended networking card, the extension card comprising a plurality of pages each for bearing at least one of a greeting or other message, a drawing and an object added to the extended networking card by successive recipients of the extended networking card.

The extension card allows the original card to be extended, in principle as many times as desired. It may be that the initial sender knows how many recipients will receive the card and will ensure that an initial extended card having sufficient pages is initially sent. Alternatively, an intermediate or a final recipient of a card can extend the original card by adding the extension card. Further extension cards can be added as desired.

The connecting means may conveniently comprise an adhesive provided on at least one of the networking card and the extension card for adhering the networking card and the extension card together.

One or more further extension cards and connecting means for connecting the extension cards together may be provided.

According to another aspect of the present invention, there is provided a method of sending a networking card to plural recipients, the networking card comprising a plurality of pages for bearing at least one of a greeting or other message, a drawing and an object added to the networking card by successive recipients of the networking card, the method comprising the steps of:

(A) a sender sending the networking card to a recipient;

(B) said recipient receiving said card, adding at least one of a greeting or other message, a drawing and an object to the networking card, and then sending said networking card to a further recipient;

(C) the further recipient adding at least one of a greeting or other message, a drawing and an object to the networking card, and then sending said networking card to a recipient; and, (D) repeating steps (B) and (C) until each of the pages of the networking card bear at least one of a greeting or other message, a drawing and an object.

Again, it will be understood that when a card is "sent" from one person to another, the card will typically be sent by means of a postal service (whether a state-run postal service or a private postal or courier or other delivery service).

The name and address of the intended ultimate recipient may be added by the initial sender. The intended ultimate recipient may be the initial sender.

The method may comprise the further step of connecting an extension card to the networking card to form an extended networking card, the extension card comprising a plurality of pages each for bearing at least one of a greeting or other message, a drawing and an object added to the extended networking card by successive recipients of the extended networking card, and repeating steps (B) and (C) using said extended networking card in place of the original networking card.

The networking card may comprise a connector for connecting the networking card to another card, the method comprising the further step of connecting the networking card to another card to form an extended networking card, and repeating steps (B) and (C) using said extended networking card in place of the original networking card.

The method may comprise the step of affixing a token to a page or other portion of the networking card prior to sending the networking card to a recipient.

According to another aspect of the present invention, there is provided a method of sending a networking card to plural recipients, the networking card comprising a plurality of pages for bearing at least one of a greeting or other message, a drawing and an object added to the networking card by successive recipients of the networking card, the method comprising the steps of:

(A) a sender sending the networking card to a recipient;

(B) said recipient receiving said networking card;

(C) said recipient connecting the networking card to another networking card or to an extension card to form an extended networking card; and, (D) said recipient sending said extended networking card to a further recipient.

The method preferably comprises the step of at least one of said recipient and a further recipient adding at least one of a greeting or other message, a drawing and an object to the networking card and then sending said extended networking card to a further recipient.

BRIEF DESCRIPTION OF THE DRAWINGS

Embodiments of the present invention will now be described by way of example with reference to the accompanying drawings, in which.

DETAILED DESCRIPTION OF THE PREFERRED EMBODIMENTS

Figure 1:
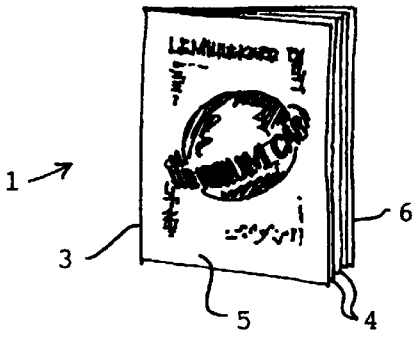
FIG. 1 is a schematic perspective view of a first example of a networking card according to the present invention.
Figure 2:
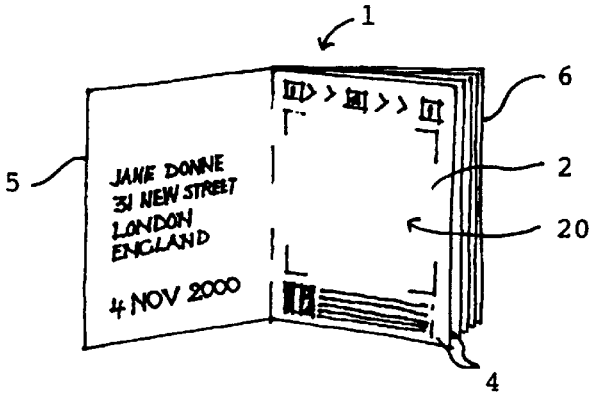
FIG. 2 is a schematic perspective view of the card shown in FIG. 1 open at a first page.
Figure 3:
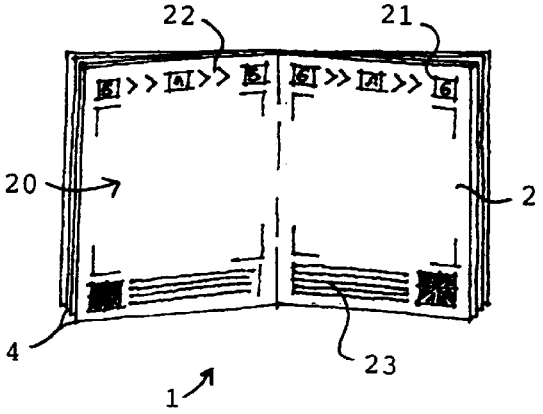
FIG. 3 is a schematic perspective view of the card of FIGS. 1 and 2 open at central pages.
Figure 4:
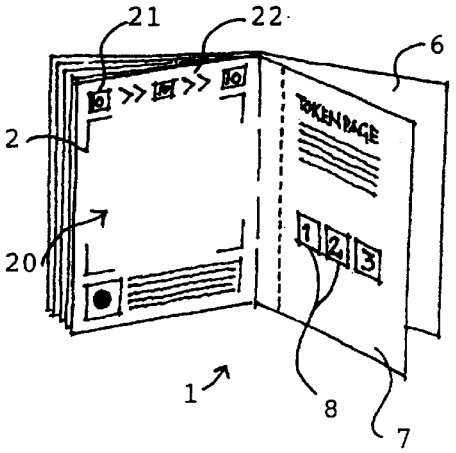
FIG. 4 is a schematic perspective view of the example shown in FIGS. 1 to 3 open at a token page.

Referring to the drawings, a networking card 1 has a plurality of pages 2. In the example shown, the pages 2 are joined at a single central spine 3 of the card 1. However, other configurations for the card 1 are possible. For example, the pages 2 of the card 1 may be folded, possibly in a concertina-like manner. As another example, the card 1 as a whole or the pages 2 individually may be rolled. In the example shown, there are five internal leaves 4 each of which provides two pages 2 of the card 1. The card 1 has a front cover 5 and a back cover 6. There is also an additional leaf 7 which provides a token page 7 which is detachable and which will be discussed in more detail further below.

Each of the pages 2 provided by the first five internal leaves 4 has a plain portion 20 on which may be written a greeting or other message by a sender of the card 1. Each page 2 also has a region carrying the sequential page number 21 of that page 2. Each page 2 also has arrows 22 indicating the direction in which the pages 2 should be used. It will be appreciated that the arrows 22 can be particularly important or useful given that the same card 1 will be used in countries that read from left to right and in countries that read from right to left and in which books are read from the front to the back and from the back to the front. Each page 2 may also have a portion 23 where instructions for use of the networking card 1 can be printed, the instructions preferably being provided in different languages throughout the card 1.

As mentioned above, the card 1 can be used in many different ways. For example, the name and address of an initial sender or possibly an ultimate recipient can be added to the inside of the front cover 5 of the card 1. A first sender can add a message to the first page 2 of the card 1 and then send the card 1 to a first recipient. That first recipient can add a message to the second page 2 of the card 1 and then send the card on to a second recipient. The process is repeated until all of the pages 2 of the card 1 bear a message and/or the card is returned to its initial sender or sent to its ultimate recipient. The card 1 can be used in this manner to create a memento to commemorate some special event for example, with each recipient adding a message which is personal to the ultimate recipient of the card 1 and which is relevant to the event being commemorated. Recipients may wish to add photographs or other articles to the card 1 and the card 1 may be provided with pockets, adhesive pads, etc. (not shown)

for this purpose. In addition to or instead of writing messages in a card 1, a sender of the card can add a part of a drawing or write a portion of a story. The next recipient/sender adds another part of the drawing or writes another portion of the story. This process can be repeated, following the rules of the corresponding children's or "parlour" games. The card 1 can be used as part of a school or other project, with pupils or students adding text, drawings or objects relating to the theme of the project. The card 1 can also be used by a network of schools, with pupils or students of different schools adding text, drawings or objects to develop a joint project as the card 1 circulates.

Figure 5:
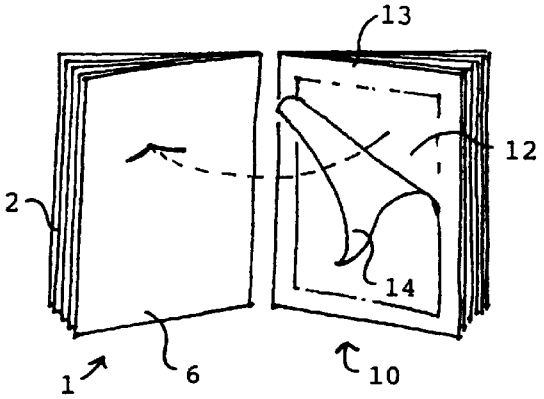
FIG. 5 is a schematic perspective view of the rear of the example of FIG. 1 and an additional extension card.

An extension card 10 may be provided. An example is shown in FIG. 5. The extension card 10 is very similar to the networking card 1 in that it has a plurality of leaves 11 providing pages which are very similar or identical to the pages 2 of the networking card 1 and on which messages can correspondingly be written by recipients. The extension card 10 has an adhesive pad 12 on a front cover 13 of the extension card 10. The adhesive pad 12 is protected by a protective film 14 which can be peeled back to allow the front cover 13 of the extension card 10 to be adhered to the rear of the back cover 6 of the networking card 1. In this way, a composite extended networking card is provided having further pages on which messages can be written by further recipients of the extended networking card 1. Further extension cards 10 can be added to extend the extended networking card yet further. It will be appreciated that other means 12 for connecting the extension cards 10 to the networking card 1 or other extension cards 10 may be provided, including for example hook-and-loop connectors, tabs and slots, staples, etc.

Figure 6:
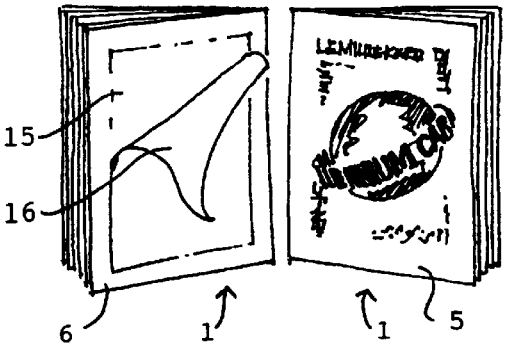
FIG. 6 is a schematic perspective view of a second example of a networking card according to the present invention.

As an alternative to providing dedicated extension cards 10 to extend the networking card 1, each networking card 1 itself may be attachable to another networking card 1. This can be achieved in a number of ways. For example, as shown in FIG. 6, each networking card 1 may be provided on the outer face of the rear cover 6 with an adhesive pad 15, covered by a removable protective film 16, which allows the rear cover 6 of one networking card 1 to be fixed to the front cover 5 of an additional networking card 1. This concatenation of networking cards 1 can in principle be extended to any number of networking cards 1.

The networking card 1 can be provided with a connector 15, such as an adhesive pad, on both the front cover 5 and the rear cover 6. This provides users with the option of extending the card 1 by adding one or more networking cards 1 and/or extension cards 10 to the front and/or the rear of the original networking card 1 or an extended networking card.

Given that the networking card 1, and optionally any extension cards 10, can be used in countries that read from left to right and in countries that read from right to left and in which books are read from the front to the back and from the back to the front, it may be advantageous to arrange the cards 1,10 such that they can be used either way up and optionally from front to back and from back to front. For example, instructions for use of the cards 1,10 can be printed "the right way up" at the top of pages 2 and "upside down" at the bottom of pages 2 of the networking card 1 or extension card 10, which allows the card 1,10 to be used from left to right and from right to left. Providing connectors 15 on both the front cover 5,13 and the rear cover 6 of the card 1,10 also facilitates use of the cards 1,10 optionally from left to right and from right to left.

Figure 7:
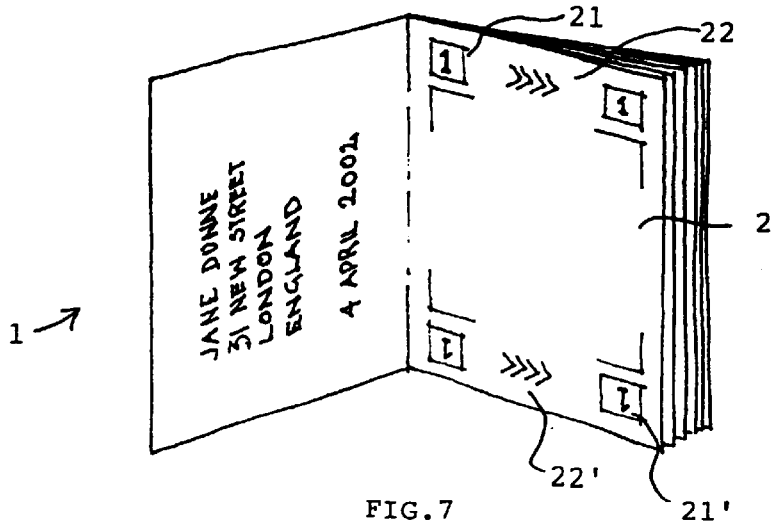
FIGS. 7 to 9 are schematic perspective views of a third example of a networking card according to the present invention; and, FIG. 10 is a schematic perspective view showing usage of another example of a networking card according to the present invention.
Figure 8:
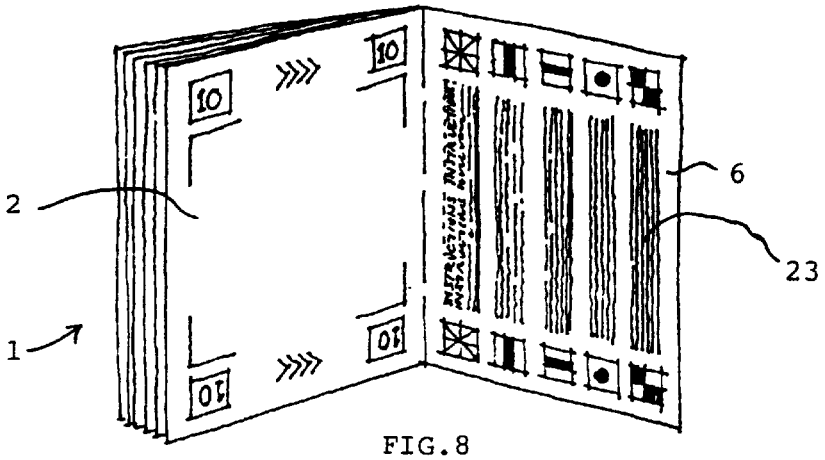
Figure 9:
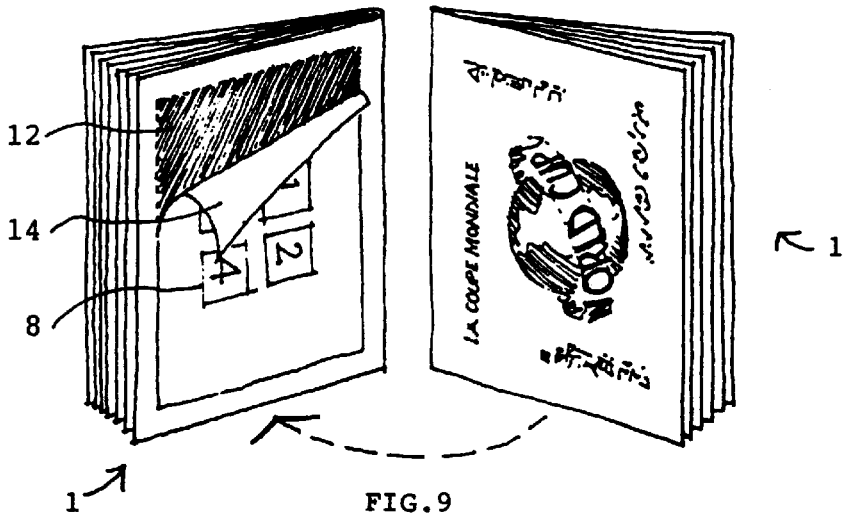

Another example of a card 1 that can be used in countries that read from left to right and in countries that read from right to left and in which books are read from the front to the back and from the back to the front is shown in FIGS. 7 to 9. In this example, the page number 21 and arrows 22 indicating the direction to the next page are printed at the "top" of each page 2 shown in FIGS. 7 to 9 to indicate usage from left to right. The page number 21' and arrows 22' indicating the direction to the next page are also printed at the "bottom" of each page 2 shown in FIGS. 7 to 9 with the page numbers 21' printed the other way up and the arrows 22' pointing to indicate usage from right to left. The instructions 23 for use of the card 1 in this example can be printed in several languages on the inside of the rear cover 6 of the card 1. Tokens 8 can be affixed to the outside of the rear cover 6. The tokens 8 can be affixed to a removable protective film 14 which covers an adhesive pad 12 on the outside of the rear cover 6. The protective film 14 can be removed to allow a further networking card 1 or an extension card (not shown) to be connected to the first networking card 1.

Figure 10:
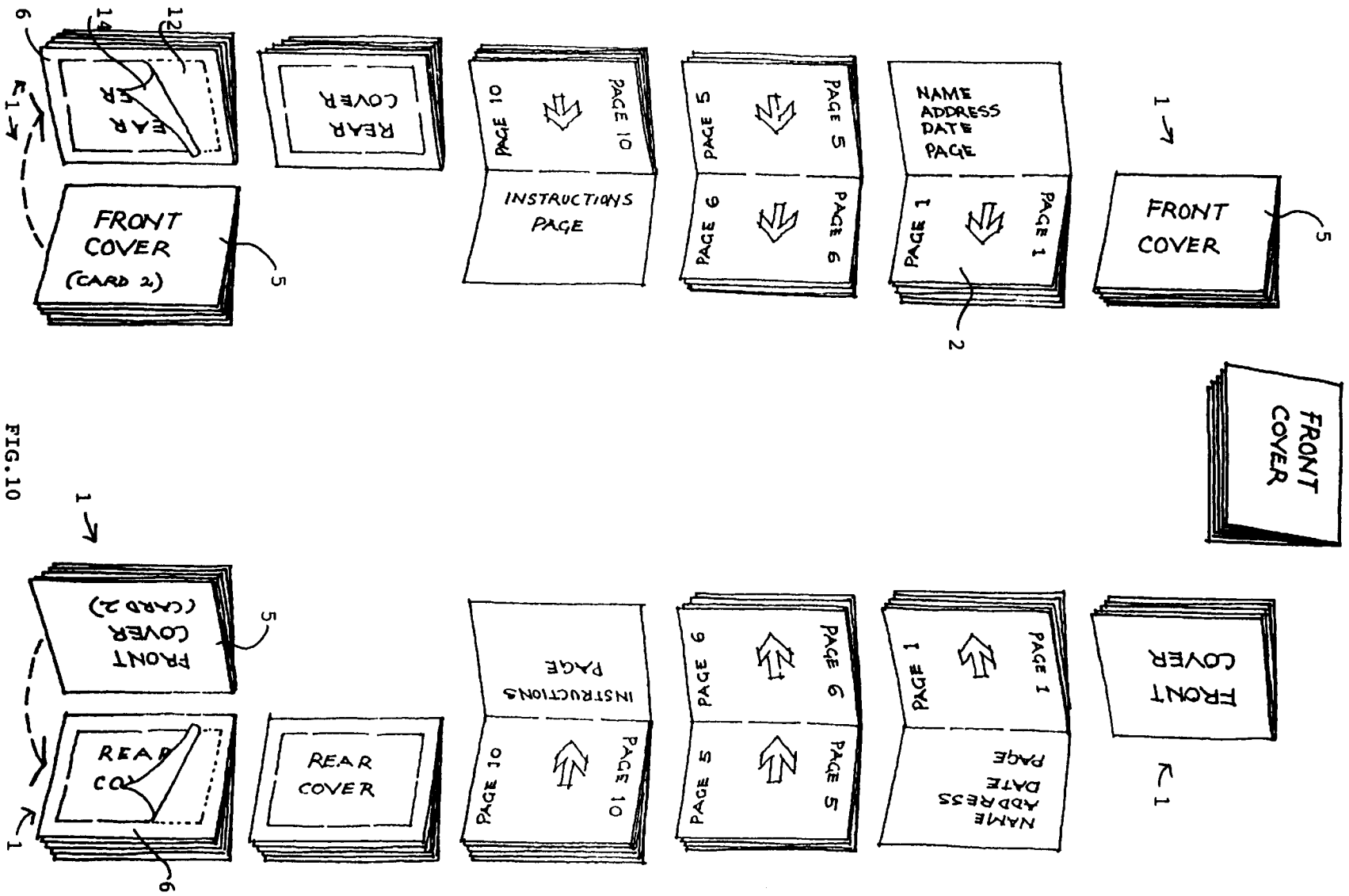

Use of an example of the networking card 1 from left to right and alternatively from right to left is shown schematically in FIG. 10. Proceeding from a "neutral" configuration of the card 1 shown at the top of FIG. 11, if the card 1 is to be used from left to right, as indicated on the left side of FIG. 10 the card 1 can be turned so that the spine 3 is to the user's left and pages 2 turned to the left until all pages 2 have been used. The card 1 can then be extended if desired by connecting a second networking card 1 (or an extension card, not shown) to the first networking card 1 by removing a protective film 14 to expose an adhesive pad 12 on the outside of the rear cover 6 of the first card 1 and affixing the front cover 5 of the second networking card 1 to the rear cover 6 of the first networking card 1. If the card 1 is to be used from right to left, as indicated on the right side of FIG. 10 the card 1 can be turned so that the spine 3 is to the user's right and pages 2 turned to the right until all pages 2 have been used. The card 1 can again be extended if desired by connecting a second networking card 1 (or an extension card, not shown) to the first networking card 1 by removing a protective film 14 to expose an adhesive pad 12 on the outside of the rear cover 6 of the first card 1 and affixing the front cover 5 of the second networking card 1 to the rear cover 6 of the first networking card 1.

The networking card 1 may be purchased, optionally in a pack, with at least one token 8. Preferably, the same two non-identical or non-matching tokens 8 are provided with each single networking card 1. The tokens 8 can be used in several different ways. For example, the initial sender can affix one token 8 to the token page 7 when initially sending the networking card 1 to the first recipient and the sender may either retain the other token 8 or send the other token 8 with the networking card 1 to the first recipient. The first recipient may also decide to purchase a new networking card 1 to initiate a separate network of recipients for the new networking card 1. In purchasing a new networking card 1, the first recipient will purchase tokens 8 with that new networking card 1. One of those tokens 8 can be affixed to the token page 7 of the first networking card 1 to match the first token 8 affixed by the first sender and the first recipient can affix the other token 8 purchased with the new networking card 1 to the token page 7 of the new networking card 1. Subsequent recipients of the first and new networking cards 1 can act similarly or may in any event have spare tokens 8 which can be affixed to received networking cards 1 to match the other tokens 8 already affixed to the token pages 7 of those networking cards 1. It will be appreciated that if the initial sender of the first networking card 1 also sent the second token 8 associated with the first networking card 1 to the first recipient, the first recipient can also affix that second token 8 to the token page 7 of the new networking card 1. In any event, the token page 7 of any particular networking card 1 will gradually fill with matching tokens 8. When a predetermined number of tokens 8 have been affixed to a networking card 1, then, by prior arrangement, the token page 7 filled with tokens 8 can be detached from the networking card 1 and redeemed with a participating retailer for an extension card 10. This will encourage the passing on of networking cards 1 and the purchase of new networking cards 1 as well as adding to the entertainment value of the sending and receiving of networking cards 1 and optional attached extension cards 10.

The extension cards 10 may include a detachable token page (not shown) corresponding to the detachable token page 7 of the networking cards 1, though normally tokens will not be provided with extension cards 10.

The number of tokens 8 provided in a pack with a new networking card 1, the number of leaves 4,11 in a networking card 1 or extension card 10, and the number of tokens 8 required in order to obtain a free extension card 10, can be set so that free extension cards 10 are relatively easily obtained whilst still encouraging purchase of new networking cards 1.

An embodiment of the present invention has been described with particular reference to the examples illustrated. However, it will be appreciated that variations and modifications may be made to the examples described within the scope of the present invention. For example, the networking cards 1 when purchased may be supplied with an envelope for sending on the card 1. Postage for the card 1 may be prepaid. The cards 1 can be used as part of a fund-raising exercise, for example to raise money for charity with a certain percentage of the sales value of the cards 1 being donated to charity.

I claim:

1. A networking card, the networking card comprising at least two leaves for bearing at least one of a greeting or other message, a drawing and an object added to the networking card by successive recipients of the networking card, said leaves being integrally formed or permanently connected to each other, one of said at least two leaves providing an outwardly facing front page of the networking card and the or another of said at least two leaves providing an outwardly facing back page of the networking card, the networking card having a connector on at least one of the front page and the back page by which a recipient of the networking card can connect the networking card to another networking card or to an extension card.

2. A networking card according to claim 1, wherein said connector is provided on the back page of the networking card.

3. A networking card according to claim 1, wherein said connector is provided on the front page of the networking card.

4. A networking card according to claim 1, wherein said connector is provided on the back page of the networking card and further comprising a connector on the front page of the networking card.

5. A networking card according to claim 1, wherein each connector comprises an adhesive.

6. A networking card according to claim 5, wherein each connector comprises a detachable protective cover.

7. A networking card according to claim 6, wherein each detachable protective cover is arranged such that at the option of a sender of the networking card the detachable protective cover can be removed and reversed to disable the connector.

8. A method of sending a networking card to plural recipients, the networking card comprising at least two leaves for bearing at least one of a greeting or other message, a drawing and an object added to the networking card by successive recipients of the networking card, said leaves being integrally formed or permanently connected to each other, one of said at least two leaves providing an outwardly facing front page of the networking card and the or another of said at least two leaves providing an outwardly facing back page of the networking card, the networking card having a connector on at least one of the front page and the back page by which a recipient of the networking card can connect the networking card to another networking card or to an extension card, the method comprising the steps of:

(a) a sender sending the networking card to a recipient;

(b) said recipient receiving said networking card, adding at least one of a greeting or other message, a drawing and an object to the networking card, and then sending said networking card to a further recipient;

(c) the further recipient adding at least one of a greeting or other message, a drawing and an object to the networking card, and then sending said networking card to a recipient;

(d) repeating steps (b) and (c) until each of the pages of the networking card bear at least one of a greeting or other message, a drawing and an object; and (e) connecting the networking card to another networking card or to an extension card by use of the connector to form an extended networking card.

* * * * *